US010113811B2

(12) United States Patent
Wilkins et al.

(10) Patent No.: US 10,113,811 B2
(45) Date of Patent: Oct. 30, 2018

(54) TUBE FOR HEAT EXCHANGER

(71) Applicant: Halla Visteon Climate Control Corp., Daejeon (KR)

(72) Inventors: Keith Wilkins, Goldhanger Maldon (GB); Richard Armsden, Billericay (GB); Nigel Seeds, Benfleet (GB)

(73) Assignee: HANON SYSTEMS, Daejeon-Si (KR)

( * ) Notice: Subject to any disclaimer, the term of this patent is extended or adjusted under 35 U.S.C. 154(b) by 566 days.

(21) Appl. No.: 14/153,476

(22) Filed: Jan. 13, 2014

(65) Prior Publication Data

US 2014/0196877 A1 Jul. 17, 2014

(30) Foreign Application Priority Data

Jan. 14, 2013 (GB) ..... 1300631.7

(51) Int. Cl.

| | |
|---|---|
| ***F28F 1/00*** | (2006.01) |
| ***F28F 9/16*** | (2006.01) |
| ***F28D 1/03*** | (2006.01) |
| ***F28F 1/02*** | (2006.01) |
| *B21D 41/02* | (2006.01) |
| *B21C 37/15* | (2006.01) |

(52) U.S. Cl.

CPC ..... *F28F 1/006* (2013.01); *F28D 1/0391* (2013.01); *F28F 1/022* (2013.01); *F28F 1/025* (2013.01); *F28F 9/16* (2013.01); *B21C 37/151* (2013.01); *B21C 37/155* (2013.01); *B21D 41/026* (2013.01)

(58) Field of Classification Search

CPC .. F28F 1/006; F28F 1/022; F28F 1/025; F28F 9/16; F28D 1/0391

USPC ..... 165/178, 183, 177, 173

See application file for complete search history.

(56) References Cited

U.S. PATENT DOCUMENTS 1,365,930 A 1/1921 Martin
5,579,832 A * 12/1996 Le Gauyer ..... B21D 41/00 165/173
5,579,837 A * 12/1996 Yu ..... B21C 37/151 165/177

(Continued)

FOREIGN PATENT DOCUMENTS

| | | |
|---|---|---|
| EP | 0772017 A2 | 5/1997 |
| FR | 914783 A | 10/1946 |
| WO | 86/07628 A1 | 12/1986 |

OTHER PUBLICATIONS

UK Intellectual Property Office, Combined Search and Examination Report dated Jun. 5, 2013, United Kingdom.

*Primary Examiner* — Raheena R Malik

(74) *Attorney, Agent, or Firm* — Shumaker, Loop & Kendrick, LLP; James D. Miller

(57) ABSTRACT

A folded tube for a heat exchanger is disclosed. The tube includes first and second ends for connection to first and second headers of the heat exchanger. An outer wall of the tube provides at least two channels for carrying a heat exchange fluid between the first and second headers. At least one seam is formed in the outer wall extending the length of the tube, the seam including a pair of opposed flanges extending into the tube to form the two channels, the outer wall joined together along the seam. The tube further includes a first end region and a second end region, and an intermediate region. The tube flattened along its length to form at least two flattened lobes, each lobe including one of the channels, and the lobes in the intermediate region being flatter than the lobes in at least one of the end regions.

15 Claims, 4 Drawing Sheets

(56) References Cited

U.S. PATENT DOCUMENTS

| | | | | | |
|---|---|---|---|---|---|
| 5,709,028 | A * | 1/1998 | Kreutzer | B21D 53/085 | 29/523 |
| 5,765,634 | A | 6/1998 | Martins | | |
| 6,000,461 | A * | 12/1999 | Ross | F28D 1/0391 | 138/115 |
| 6,129,147 | A * | 10/2000 | Dumetz | F28D 1/0391 | 165/177 |
| 6,209,202 | B1 * | 4/2001 | Rhodes | B21C 37/151 | 165/177 |
| 6,230,533 | B1 * | 5/2001 | Laveran | B21C 37/14 | 165/177 |
| 6,263,570 | B1 | 7/2001 | Cazacu | | |
| 6,470,964 | B1 * | 10/2002 | Nakado | F28D 1/0391 | 165/133 |
| 6,591,900 | B1 * | 7/2003 | Kato | F28D 1/0391 | 138/115 |
| 6,739,386 | B2 | 5/2004 | Lamich et al. | | |
| 6,810,951 | B1 * | 11/2004 | Dumetz | F28F 9/182 | 165/173 |
| 2001/0022221 | A1 * | 9/2001 | Yamauchi | B21C 37/151 | 165/177 |
| 2002/0005281 | A1 * | 1/2002 | Krupa | F28D 1/0391 | 165/177 |
| 2004/0182559 | A1 | 9/2004 | Kent et al. | | |
| 2006/0201665 | A1 * | 9/2006 | Yu | B21C 37/08 | 165/177 |
| 2006/0219393 | A1 * | 10/2006 | Igami | B21C 37/083 | 165/133 |
| 2007/0034366 | A1 * | 2/2007 | Igami | F28D 1/0391 | 165/177 |
| 2008/0245513 | A1 * | 10/2008 | Itoh | B21C 37/155 | 165/148 |
| 2011/0284195 | A1 * | 11/2011 | Chowdhury | F28D 1/0391 | 165/174 |

* cited by examiner

TUBE FOR HEAT EXCHANGER

CROSS-REFERENCE TO RELATED APPLICATION

The present application claims the benefit of United Kingdom Patent Application Serial No. 1300631.7 filed Jan. 14, 2013, hereby incorporated herein by referenced in its entirety.

FIELD OF THE INVENTION

The present invention relates to tubes for use in heat exchangers, and more particularly to folded tubes for use in heat exchangers in motor vehicles.

BACKGROUND OF THE INVENTION

Typically, automotive vehicles are provided with an engine cooling system including a heat exchanger, such as a radiator. When the engine is running, heat is transferred from the engine to a coolant that flows through the engine. The coolant then flows from the engine to the heat exchanger through a series of conduits. At the heat exchanger, heat is transferred from the coolant to cooler air that flows over the outside of the heat exchanger. This process repeats itself in a continuous cycle, thereby cooling the engine.

A typical heat exchanger includes a series of tubes supported by two chambers or headers positioned at either end of the heat exchanger. The headers are usually joined to the tubes by means of brazing. During operation of the engine and cooling system, the tubes are subject to thermal cycling (rise and fall of the temperature of the heat exchanger components) which leads to stresses as neighboring tubes may expand to different degrees such that axial loads are imposed on tubes by their neighbors.

In many systems, the tubes comprise a single enclosed channel. The tubes have a generally elongate, substantially rectangular cross-sectional shape, and comprise two opposing longer sides, or faces, and two opposing curved shorter sides, or noses. Within the heat exchanger, the tubes are arranged side by side with the faces of neighboring tubes opposing each other and defining a space or passage between the tubes through which air can flow. This geometry of the tubes is, therefore, favorable as it creates a relatively large surface area over which the cooler air can pass whilst minimizing the disruption to the air flow through the heat exchanger. However, these types of header/tube combinations are prone to failure because of the stress concentrations that occur along the header/tube joint, in particular around the noses of the tubes.

To overcome some of the disadvantages of single channel tubes, a number of tube designs have been developed in which the tubes are formed from a folded sheet of metal. These folded tubes, or 'B-tubes', have a longitudinal seam separating two channels. The overall cross-sectional shape of these tubes is, however, substantially the same as that of the single channel tubes to benefit from the large surface area and minimal disruption to air flow.

These folded tubes, however, still possess a number of disadvantages. Firstly, the cross-sectional area of the tube dictates the required dimensions of the headers. In particular, the longer cross-sectional dimension of the tubes dictates the minimum width of the headers, and thereby the minimum width of the heat exchanger. Secondly, the elongate cross-sectional shape of the tubes creates a narrow opening at the end of the tube that generates undesirable entry and exit pressure losses. Thirdly, although the design of the folded tubes is known to reduce the likelihood of failure of the header/tube joint around the nose of the tubes, the small radius of the nose of each the tubes still leads to stress concentrations in these regions.

It is, therefore, an object of the present invention to provide an improved tube for a heat exchanger that overcomes these problems.

SUMMARY OF THE INVENTION

According to a first aspect of the invention, there is provided an elongate tube for a heat exchanger, the tube comprising: a first end and a second end for connection to, respectively, first and second headers of the heat exchanger; an outer wall, the outer wall encompassing an internal volume, the internal volume providing at least two channels for carrying a heat exchange fluid the length of the tube between the first and second headers; and at least one seam in the outer wall extending the length of the tube, each seam including a pair of opposed flanges, the pair of opposed flanges extending into the internal volume to divide the volume into two of the channels and the outer wall being joined together along the length of each seam, wherein the elongate tube has proximate the first end a first end region and proximate the second end a second end region, and between the first and second end regions an intermediate region, the tube being flattened along substantially all of its length such that the flanges divide the internal volume into at least two flattened lobes, each lobe providing one of the channels and each lobe extending laterally away from the flanges relative to the length of the tube, and at least two of the lobes in the intermediate region being flatter as hereinbefore defined than the lobes in at least one of the end regions.

In an embodiment of the invention, the lobes in the intermediate region are flatter than the lobes in both end regions.

The outer wall may have opposite broad portions, these broad portions being flared outwards from the intermediate region to at least one of, and preferably both of, the first and second ends. At least one of the end regions is therefore flared outwards in part.

The outer wall may have opposite narrow portions, these narrow portions being flared inwards from the intermediate region to at least one of, and preferably both of, the first and second ends. At least one of the end regions is therefore flared inwards in part.

The distance between the opposite broad portions may be substantially constant along the length of the seam through the intermediate and both end regions.

In another embodiment of the invention, at least one of the flanges is joined along its length to a portion of the outer wall opposite the corresponding seam, so that adjacent ones of channels on opposite sides of said flanges are not in fluid communication with each other. Also, in yet another embodiment, the lobes in the intermediate region extend further from the pair of flanges than the lobes in the at least one end region.

The outer wall may have a substantially constant thickness.

The perimeter lengths of cross-sections through the tube in a plane perpendicular to the length of the tube may be substantially the same in both the intermediate region and at least one of, and preferably both of, the end regions.

The lobes may be substantially symmetric on opposite sides of an intervening pair of flanges.

In another embodiment of the invention, each of the lobes in one, or both end regions is flatter in a portion proximate the flanges than in a portion further from the flanges in a lateral direction relative to the length of the tube.

According to another aspect of the invention, there is provided a heat exchanger comprising: at least one elongate tube, the elongate tube being according to the first aspect of the invention; and at least one header including at least one aperture, the at least one end region of the tube extending through the aperture to connect the tube to the header.

The header may comprise a flanged edge extending around at least part of the perimeter of the aperture, the end region of the tube being connected to the flanged edge.

BRIEF DESCRIPTION OF THE DRAWINGS

The above, as well as other advantages of the present disclosure, will become readily apparent to those skilled in the art from the following detailed description, particularly when considered in the light of the drawings described herein.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, are not necessary or critical.

Figure 1:
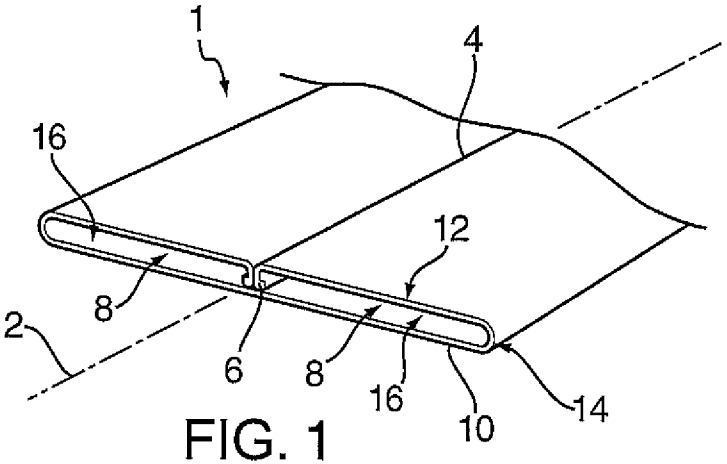
FIG. 1 PRIOR ART
FIG. 1 is a fragmentary perspective view of an end region of a prior art folded tube suitable for use in a heat exchanger.
Figure 2:
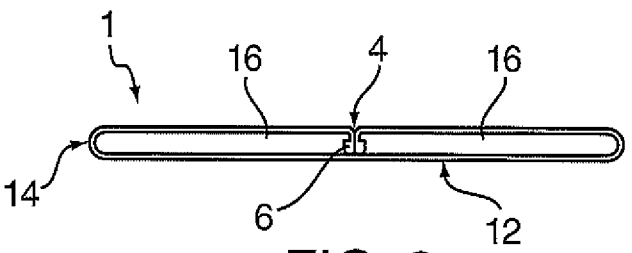
FIG. 2 PRIOR ART
FIG. 2 is an end view of the prior art folded tube of FIG. 1.

FIGS. 1 and 2 illustrate a conventional folded tube 1 for use in a heat exchanger, such as a radiator of a motor vehicle. This type of folded tube 1 is often referred to as a 'B-tube' due to its cross-sectional shape perpendicular to a longitudinal axis 2 of the tube 1. These folded tubes 1 offer increased strength compared to tubes having a single channel, whilst allowing the use of thinner and lighter materials in their construction.

The folded tubes 1 are typically formed from sheet metal, for example aluminium. Two opposing edges of the sheet are brought together to form a seam 4 along the length of the tube 1, and this seam 4 is then brazed to seal the tube 1. The edges of the sheet creating the seam 4 include flanges 6 and, when the sheet metal is folded to form the tube 1, these flanges 6 extend into the resulting internal volume 8 of the tube 1.

The tube 1 is generally flattened such that it has a first, wider or broader dimension and a second, thinner or narrower dimension. In particular, an outer wall 10 of the tube comprises opposing, generally planar, broad portions 12 and opposing, generally curved, narrow portions 14 extending between the broad portions. The tube 1 is flattened so that the seam flanges 6 extend across the narrower dimension of the tube 1 and, in this way, the flanges 6 divide the internal volume 8 of the tube 1 into two channels 16 extending along the length of the tube 1 on either side of the flanges 6. Typically, a seal will be made between these flanges 6 and the opposing part of the outer wall 10 to form two separate and distinct channels 16 for the passage of a heat exchange fluid (not shown). The flanges are not joined to the opposite broad portions 12 so the two channels 16, although substantially separate, remain in fluid communication.

In the context of the present invention, the term "flat" or "flattened" is used in relation to an object having a broad thin shape, i.e. an object having a relatively broad surface in relation to a thickness or depth. The term 'flatter' means that a first shape or object is generally thinner in relation to its breadth than a second shape or object, i.e. the flatter object generally has a higher aspect ratio cross-sectional shape than the other object.

Figure 5:
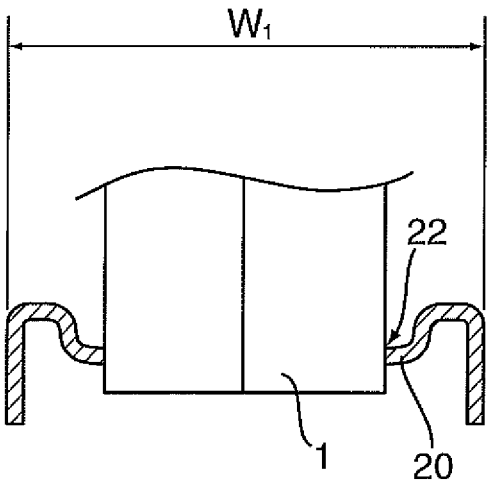
FIG. 5 PRIOR ART
FIG. 5 is a cross-sectional view of a part of a header for a heat exchanger showing the end region of the prior art folded tube of FIG. 1 inserted into the header.
Figure 6:
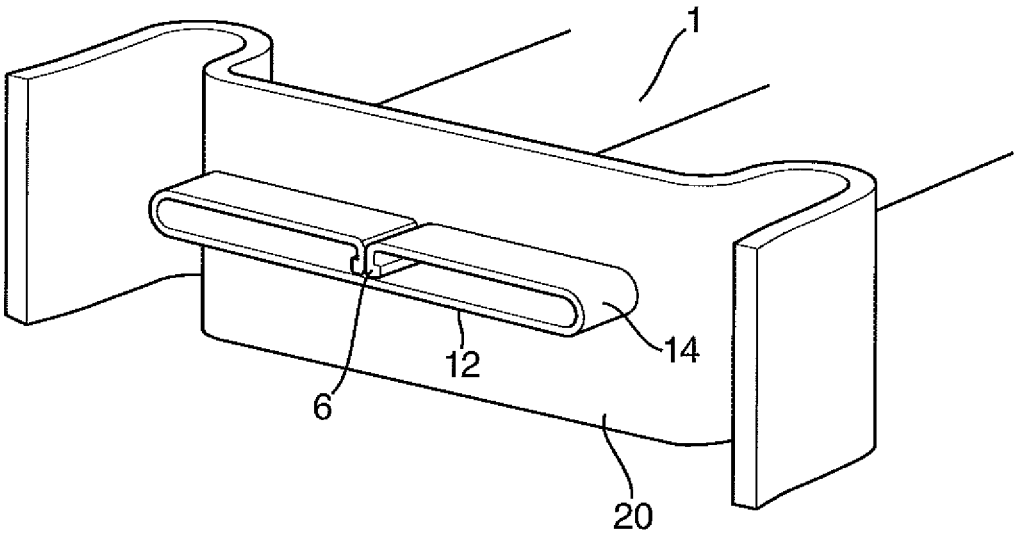
FIG. 6 PRIOR ART
FIG. 6 is a fragmentary perspective view of the header and folded tube of FIG. 5.

FIGS. 5 and 6 show an end of a prior art folded tube 1 connected to a part of a header 20 of a heat exchanger.

In a typical heat exchanger, a plurality of folded tubes 1 extend between first and second headers 20 to convey a heat exchange fluid or coolant between the headers. The folded tubes 1 are spaced apart along a length of the heat exchanger, and gaps are defined between opposing broad portions of the outer walls of neighboring tubes 1.

Typically, in use, a heated coolant flows through the folded tubes 1 and a cooler fluid, for example air, flows through the gaps between the tubes. Heat energy from the coolant is transferred to the walls of the tube 1 and this heat energy is then radiated from the outer surface of the tubes, aided by the flow of the cooler fluid. The flattened shape of the tubes 1 maximizes the surface to volume ratio, maximizing the efficiency of the heat exchanger.

During operation of the heat exchanger, the tubes 1 are subject to thermal cycling (rise and fall of the temperature of the heat exchanger components) which leads to stresses, as neighboring tubes may expand to different degrees such that axial loads are imposed on tubes 1 by their neighbors. These header/tube combinations are, therefore, prone to failure because of the stress concentrations that occur along the header/tube joint 22, with failure most commonly occurring at the intersection of the curved, narrow portions 14 of the tube 1 and the header 20.

Figure 3:
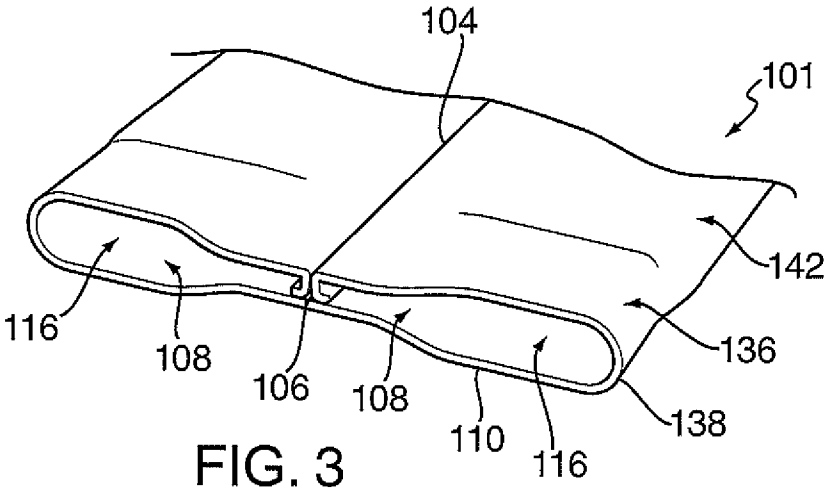
FIG. 3 is a fragmentary perspective view of an end region of a folded tube suitable for use in a heat exchanger according to the present invention.
Figure 4:
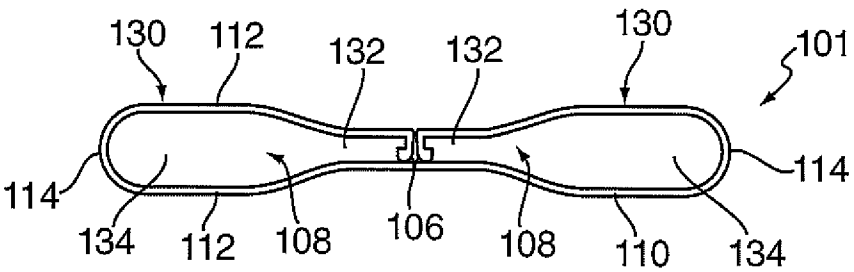
FIG. 4 is an end view of the folded tube of FIG. 4.

FIGS. 3 and 4 show a folded tube 101 according to the present invention. The folded tube 101 comprises an outer wall 110, typically formed from sheet metal, surrounding an internal volume 108 of the tube 101. The outer wall 110 comprises two opposing generally planar broad wall sections 112, hereinafter referred to as the side walls 112 of the tube 101, and two opposing generally curved narrow wall sections 114, hereinafter referred to as the noses 114 of the tube 101. The curved wall sections 114 extend between and are continuous with the planar wall sections 112 to form a complete perimeter of the tube 101.

A distance between the opposing side walls 112 defines a narrow cross-sectional dimension or width of the tube 101 and a distance between the opposing noses 114 defines a broad cross-sectional dimension or depth of the tube 101.

A seam 104 of the tube 101, which extends along the length of the tube 101, includes a pair of flanges 106 that project into the internal volume 108. The seam 104 is formed in one of the side walls 112 of the tube 101 and, as such, the flanges 106 extend across the width of the tube 101. The flanges 106 extend fully across the tube 101 so that an edge of each of the flanges 106 contacts the opposing side wall 112 of the tube 101 and in an embodiment a seal is formed between the flanges 106 and the opposing side wall 112. The flanges 106, therefore, divide the internal volume 108 into two separate channels 116, one on either side of the flanges 106. The two channels 116 are lobe-shaped 130 portions of the internal volume 108. The lobes 130 in the internal volume 108 extend laterally away from the flanges 106, relative to the length of the tube 101. Preferably, the seam 104 is formed substantially centrally in the side wall 112 such that two substantially equal sized channels 116 are formed, with substantially symmetric lobe shapes 130.

The lobes 130 extend in opposite directions away from the pair of flanges 106 and a proximal portion 132 of each lobe 130 is defined proximate the flanges 106 and a distal portion 134 of each lobe 130 is defined at a distance from the flanges 106 proximate each nose 114 of the tube 101.

In other embodiments, however, the seam 104 may not be formed centrally, and in yet further embodiments, the tube 101 may include more than one seam 104 running the length of the elongate tube 104, so that the internal volume is divided into at least three channels. In this case, the laterally outer two channels have a lobe shape similar to the present invention and each channel between the outer two channels would not necessarily be flared inwards or outwards, but may have a substantially constant cross-sectional shape.

Figure 7:
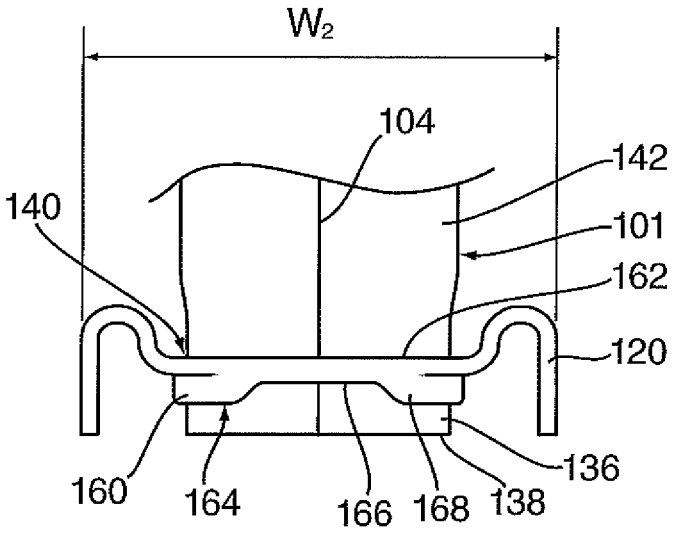
FIG. 7 is a cross-sectional view of a part of a header for a heat exchanger showing the end region of the folded tube of FIG. 3 inserted into the header, according to the present invention.
Figure 8:
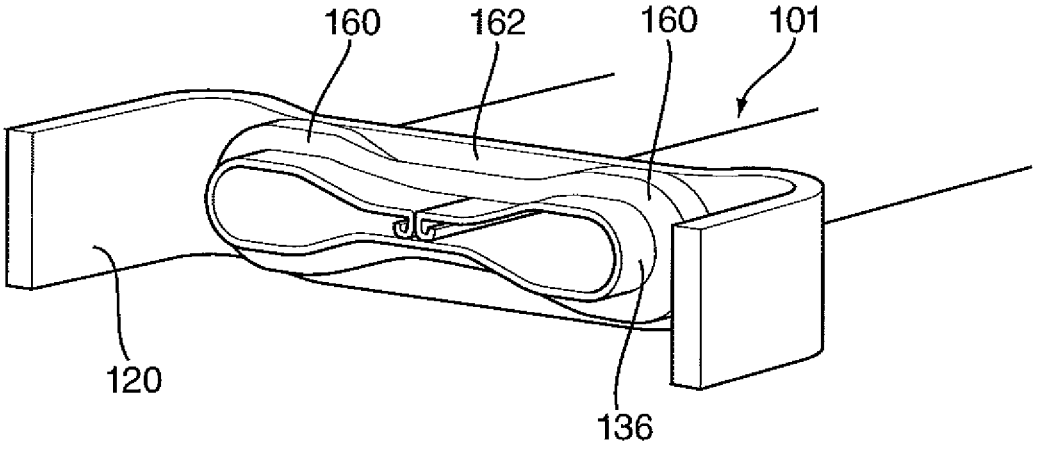
FIG. 8 is a fragmentary perspective view of the header and folded tube of FIG. 7.

The folded tube 101 further comprises a first end region 136 at a first end 138 of the tube 101 and a second end region (not shown) at an opposite, second end of the tube 101. In use, the first and second end regions 136 extend through corresponding apertures 140 in the first and second headers 120 of the heat exchanger to join the tube 101 to the headers 120, as shown in FIGS. 7 and 8. An intermediate or central region 142 of the tube 101 extends along the length of the tube 101 between the first and second end regions 136. The first and second end regions typically have the same shape, being mirror images of each other.

The lobes 130 in the intermediate region 142 are flatter than the lobes 130 in each of the first and second end regions 136. As such, the cross-sectional shape of each of the channels 116 in the intermediate region 142, in a plane perpendicular to a length of the tube 101, has a higher aspect ratio than the cross-sectional shape of each of the channels 116 in the end regions 136.

In this example, a width of the distal portion 134 of each of the lobes 130 in the end regions 136 is greater than a corresponding width of the distal portion 134 of the lobes 130 in the intermediate region 142, thereby creating flared end regions. This increase in width of the tube 101 in the flared end regions 136 increases the radius of curvature of each of the noses 114 of the tube 101 in these regions.

In another embodiment, the width of the proximal portion 132 of each of the lobes 130 in the end regions 136 is not increased relative to the width of the proximal portions 132 of the lobes 130 in the intermediate region 142. This results in the end regions 136 having substantially teardrop shaped lobes 130 and the cross-sectional shape of the tube 101 in the end regions 136 being substantially in the form of a figure eight.

The restricted width of the proximal portions 132 of the lobes 130 means that the flanges 106 still extend across the full width of the fluid flow channel 108 and retain the division of the channel into two channels 116. Accordingly, the strength and stiffness of the tube 101 is not significantly affected in the end regions 136.

FIGS. 7 and 8 show an end region 136 of a folded tube 101 of the present invention connected to a header 120 of a heat exchanger.

As shown most clearly in FIG. 7, the depth of the end region 136 of the tube 101 is less than the depth of the intermediate region 142 of the tube 101. The increase in width of the lobes 130 in the end region 136 leads to a corresponding decrease in depth, i.e. a length of a narrow dimension of each one of the lobes 130 in the end region 136 is increased and a length of a broad dimension of each of the lobes 130 is decreased. As such, perimeter lengths of cross-sections through the tube 101 in a plane perpendicular to the length of the tube 101 are preferably substantially the same in both the intermediate region 142 and the two end regions 136.

Figure 9A:
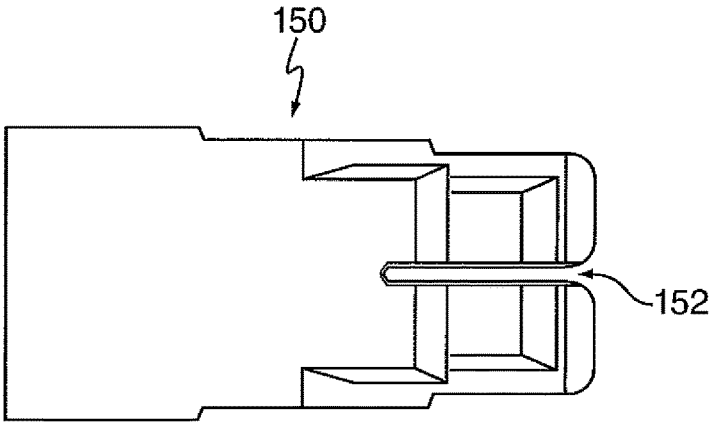
FIG. 9*a* is a side view of a forked punched used to reform the ends of the tube of FIG. 3.
Figure 9B:
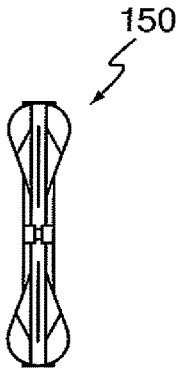
FIG. 9*b* is an end view of the forked punch of FIG. 9*a*.

In a method of manufacture of the tubes 101 of the present invention, a folded tube is initially made as is known in the prior art. A forked punch 150, shown in FIGS. 9*a* and 9*b*, is then used to locally reform one or both of the end regions 136 of the tube 101. A slot 152 in the punch 150 is sized to receive the seam 104 of the folded tube 101 formed by the flanges 106, and protect this part of the tube 101 from deformation. In this way, the seal formed by the flanges 106 is maintained between the two lobes 130 of the tube 101 while predominantly the distal part 134 of the lobes 130 is reformed.

The folded tube 101 of the present invention, therefore, has a number of advantages compared to prior art tubes. Firstly the increased radius of curvature of the nose 114 of the end regions 136, at the intersection with the header 120, decreases the stress concentrations in this region. This, in turn, reduces the likelihood of failure in this part of the tube-header joint.

To reduce the stress concentrations at the joint between headers and prior art designs of a folded tube, the shape of the header plates are typically changed to redistribute the loads along the tube/header joint. In particular, it is known to use a header plate having a generally trapezoidal cross-sectional shape, rather than a traditional flat header plate. According to the present invention, the lower aspect ratio of the end regions 136, together with the increased radius of curvature of the nose 114 of the tube 101, allows a flanged edge or ferrule 160 to be formed around the aperture 140 in the header 120 for receiving the end region 136 of the folded tube 101. The flanged ferrule 160 is preferably formed by stamping the header plate 120.

In the embodiment of the tube/header combination illustrated in FIGS. 7 and 8, the flanged ferrule 160 is formed in a generally flat header plate 120. The ferrule 160 extends from a face 162 of the header plate 120 in a direction towards the end 138 of the tube 101. The ferrule 160 reduces stress concentrations by increasing the area of the joint between the header and the tube. Furthermore, the shape of an edge 164 of the ferrule 160 is, preferably, substantially trapezoidal across the width of the header 120, such that a central region 166 of the ferrule 160 proximate the seam 104 of the tube 101 intersects the tube 101 further from the end 138 of the tube 101 than outer regions 168 of the ferrule 160 proximate the noses 114 of the tube 101. This geometry of the edge 164 of the ferrule 160 distributes stresses more evenly along the tube/header joint thereby increasing the life of the header 120 before failure. In particular, the greater stresses, caused by twisting of the header 120 and bending of the tubes 101 during thermal cycling, are now within a central portion of the header 120, proximate the seam 104 of the tube 101, and are, therefore, separated from the regions of greatest stress concentration around the nose 114 of the tube 101.

A second advantage of the present invention compared to prior art tubes is a reduction in pressure losses at the ends of the tubes 101. The higher aspect ratio geometry of prior art tube designs led to undesirable entry/exit pressure losses at the intersection of the end of the tube and the header. The flared end regions 136 of the tube 101 of the present invention have relatively lower aspect ratio geometry compared to these prior art tubes. As such, the entry/exit pressure losses, due to the geometry of the opening at the end 138 of the tube 101 are reduced, thereby improving the overall efficiency of the heat exchanger. The aspect ratio of the intermediate region 142 of the tube 101, however, remains unaltered from prior art designs of folded tube and, as such, the surface area to volume ratio in this part of the tube 101 is not affected detrimentally.

A third advantage of the tube 101 of the present invention is that the decreased depth of the end regions 136 of the tube 101 permits a reduction in the width $W_2$ of the header 120 compared to the width $W_1$ of the header used with prior art folded tubes 1. The overall size of the header 120 and the heat exchanger may, therefore, be reduced according to the present invention.

Although the embodiment of the folded tube described above included a flared end region 136 at both ends 138 of the tube 101, it will be appreciate that the tube 101 may include a flared end region 136 at only one end 138 of the tube 101.

The present invention, therefore, provides an improved folded tube for a heat exchanger that has a number of advantages over prior art designs of tube.

While certain representative embodiments and details have been shown for purposes of illustrating the invention, it will be apparent to those skilled in the art that various changes may be made without departing from the scope of the disclosure, which is further described in the following appended claims.

What is claimed is:

1. An elongate tube for a heat exchanger, the tube comprising:

a first end and a second end for connection to, respectively, a first header and a second header of the heat exchanger;

an outer wall encompassing an internal volume, the internal volume providing at least two channels for carrying a heat exchange fluid a length of the tube between the first header and the second header; and at least one seam in the outer wall extending the length of the tube, the at least one seam including a pair of opposed flanges, the flanges extending into the internal volume to divide the internal volume into the at least two channels, the outer wall joined together along the at least one seam, wherein the tube has proximate the first end a first end region and proximate the second end a second end region, and between the first end region and the second end region an intermediate region, the tube being flattened along substantially all of the length such that the flanges divide the internal volume into at least two flattened lobes, each of the at least two lobes including one of the at least two channels and each of the at least two lobes extending laterally away from the flanges relative to the length of the tube, and the at least two lobes flatter in the intermediate region than the at least two lobes in at least one of the first end region and the second end region, wherein each of the at least two lobes includes a proximal portion formed proximate the flanges and a distal portion formed laterally outwardly of the proximal portion with respect to the flanges, wherein each of the at least two lobes is substantially flat and a lower section of the at least two lobes is substantially parallel to an upper section of the at least two lobes in the proximal portion, and wherein the flanges have a bending portion contacting a portion of the outer wall opposite the at least one seam, wherein a width of the distal portion of each of the at least two lobes in the first end region is greater than a width of the distal portion of each of the at least two lobes in the intermediate region and wherein a width of the distal portion of each of the at least two lobes in the first end region is greater than a width of the proximal portion of each of the at least two lobes in the first end region.

2. The tube according to claim 1, wherein the outer wall has opposite broad portions, the broad portions flared outwards between the intermediate region and the first end.

3. The tube according to claim 1, wherein the outer wall has opposite broad portions, the broad portions flared outwards between the intermediate region and the second end.

4. The tube according to claim 1, wherein the outer wall has opposite narrow portions, the narrow portions flared inwards between the intermediate region and the first end.

5. The tube according to claim 1, wherein the outer wall has opposite narrow portions, the narrow portions flared inwards between the intermediate region and the second end.

6. The tube according to claim 1, wherein at least one of the flanges is joined along a length thereof to the portion of the outer wall opposite the at least one seam at the bending portion, so adjacent ones of the at least two channels are not in fluid communication with each other.

7. The tube according to claim 1, wherein the at least two lobes in the intermediate region of the tube extend further from the flanges than the at least two lobes in the at least one end region of the tube.

8. The tube according to claim 1, wherein the outer wall has a substantially constant thickness.

9. The tube according to claim 1, wherein a length of a perimeter of the tube in a plane perpendicular to the length of the tube is substantially the same in the intermediate region of the tube and the first end region and the second end region of the tube.

10. The tube according to claim 1, wherein the at least two lobes are substantially symmetric in respect of the flanges.

11. A heat exchanger including the tube recited in claim 1, the heat exchanger comprising:

a header including an aperture, one of the first end region and the second end region of the tube extending through the aperture to connect the tube to the header.

12. The heat exchanger according to claim 11, wherein the header further comprises a flanged edge extending around at least part of a perimeter of the aperture, the one of the first end region and the second end region of the tube connected to the flanged edge.

13. The tube according to claim 1, wherein a width of the proximal portion of each of the at least two lobes in the first end region is equal to a width of the proximal portion of each of the at least two lobes in the intermediate region.

14. An elongate tube for a heat exchanger, the tube comprising:

a first end region formed adjacent a first end of the tube;

an intermediate region formed intermediate the first end region and a second end of the tube;

an outer wall encompassing an internal volume; and at least one seam in the outer wall extending a length of the tube and joining the outer wall together, the at least one seam including a pair of opposed flanges extending into the internal volume to divide the internal volume into two channels, wherein the flanges have a bending portion contacting a portion of the outer wall opposite the at least one seam, wherein each of the channels forms a lobe extending laterally away from the flanges relative to the length of the tube, each of the lobes including a proximal portion formed proximate the flange and a distal portion formed laterally outwardly of the proximal portion with respect to the flanges, a width of the distal portion of the lobes in the first end region greater than a width of the distal portion of the lobes in the intermediate region, an upper portion of the outer wall in the proximal portion of each of the lobes parallel to a lower portion of the outer wall in the proximal portion of each of the lobes and wherein a width of the distal portion of each of the at least two lobes in the first end region is greater than a width of the proximal portion of each of the at least two lobes in the first end region.

15. The tube according to claim 14, wherein a width of the proximal portion of each of the at least two lobes in the first end region is equal to a width of the proximal portion of each of the at least two lobes in the intermediate region.

* * * * *